US006389647B1

(12) United States Patent
Lewis et al.

(10) Patent No.: US 6,389,647 B1
(45) Date of Patent: May 21, 2002

(54) APPARATUS AND METHOD FOR RESTORING MOISTURE TO LINT COTTON IN A COTTON GIN

(76) Inventors: Steven E. Lewis, 4569 Dunn Ave., Memphis, TN (US) 38117; Gene C. Lewis, 5480 Valley Brook Cove, Memphis, TN (US) 38120

( * ) Notice: Subject to any disclaimer, the term of this patent is extended or adjusted under 35 U.S.C. 154(b) by 0 days.

(21) Appl. No.: 09/908,211

(22) Filed: Jul. 18, 2001

(51) Int. Cl.[7] ..... D01B 3/04
(52) U.S. Cl. ..... 19/66 CC; 19/66 R
(58) Field of Search ..... 19/66 CC, 66 R, 19/65 A, 39, 48 R; 68/5 D, 5 E; 73/160, 865.6, 866; 100/73, 74, 75

(56) References Cited

U.S. PATENT DOCUMENTS

| | | | | |
|---|---|---|---|---|
| 2,914,809 A | | 12/1959 | Buzick, Jr. | 19/66 |
| 3,324,513 A | | 6/1967 | Hurdt | 19/66 |
| 3,392,424 A | | 7/1968 | Mangialardi, Jr. | 19/66 |
| 4,021,887 A | * | 5/1977 | Jackson | 19/66 R |
| 4,103,397 A | | 8/1978 | Jackson | 19/66 |
| 4,140,503 A | | 2/1979 | Vandergriff | 55/290 |
| 4,726,096 A | | 2/1988 | Woods, Jr. | 19/66 |
| 5,381,587 A | | 1/1995 | Vandergriff | 19/48 |
| 6,237,195 B1 | * | 5/2001 | Shoemaker | 19/66 CC |
| 6,240,601 B1 | * | 6/2001 | Kiser et al. | 19/66 CC |

* cited by examiner

*Primary Examiner*—Danny Worrell
*Assistant Examiner*—Gary L. Welch
(74) *Attorney, Agent, or Firm*—Walker, McKenzie & Walker, PC

(57) ABSTRACT

An apparatus and method for restoring moisture to lint cotton in a cotton gin. The moisture level of lint cotton passing from a battery condenser to a bale press, and the rate of lint cotton passing from the battery condenser to the bale press are measured, and, based on those measurements and the desired moisture level of the lint cotton at the bale press, a precise amount of water is sprayed onto the lint cotton as it passes from the battery condenser to the bale press to bring the moisture level of the lint cotton at the bale press to that desired level.

7 Claims, 22 Drawing Sheets

FIG. 3

| |
|---|
| FIG. 3A |
| FIG. 3B |
| FIG. 3C |
| FIG. 3D |
| FIG. 3E |
| FIG. 3F |
| FIG. 3G |
| FIG. 3H |
| FIG. 3I |
| FIG. 3J |
| FIG. 3K |
| FIG. 3L |
| FIG. 3M |
| FIG. 3N |
| FIG. 3O |
| FIG. 3P |
| FIG. 3Q |
| FIG. 3R |
| FIG. 3S |

APPARATUS AND METHOD FOR RESTORING MOISTURE TO LINT COTTON IN A COTTON GIN

BACKGROUND OF THE INVENTION

1. Field of the Invention

The present invention relates, in general, to cotton ginning and in particular, to a method and an apparatus for restoring moisture to lint cotton in a cotton gin.

2. Information Disclosure Statement

A modern cotton gin includes several coacting subsystems that not only separates cotton seed from lint cotton, but that also dries and cleans the lint cotton and packages the lint cotton into bales for transfer to a cotton warehouse or textile mill, etc. Seed cotton (i.e., raw cotton from the cotton field) usually arrives at the cotton gin in large trailers or modules. Some type of unloading system, such as a large suction pipe or module feed system, conveys the seed cotton from the trailers or modules to the initial stages of the ginning process, typically a moisture balancing stage to either reduce or increase its moisture content to a desired level, and a rough cleaning stage to remove leaves, small trash, sticks, etc., from the seed cotton. The partially processed seed cotton is then transferred to one or more gin stands for "ginning", i.e. for separation of the cotton seed and fiber. Each gin stand typically includes a roller gin or saw gin, etc. A typical cotton gin may have three or more gin stands. After ginning, the cotton fiber is typically referred to as "lint cotton" (sometimes referred to as "cotton lint" or just "lint"). The ginned lint may then pass through a lint cleaning stage to remove any small trash or dirt remaining in the lint. The cleaned lint is then carried through a lint flue or the like to a battery condenser, where the cleaned lint is formed into a continuous batt and discharged onto a lint slide. The batt is conveyed down the lint slide to a bale press where the batt is compressed and formed into one or more bales. Each bale may then be tied with bailing wire and wrapped with plastic, etc., before being stored or transferred to a warehouse, textile mill, etc.

For many years, cotton ginners have tried various methods to add moisture to lint cotton before the lint enters the bale press. Most of these prior methods add moisture at the lint slide, after the lint has left the battery condenser formed into a batt, and just prior to the batt entering the bale press. However, the accuracy of the resultant moisture level in the finished bale using these prior methods has not been universally acceptable. The typical prior method merely adds the same amount or volume of moisture to the batt, regardless of the rate at which the batt is moving down the slide (e.g., regardless of how many bales a gin stand is producing per hour, etc.), or of the preexisting moisture content of the batt.

A preliminary patentability search in Class 19, subclass 66C, and Class 100, subclass 74, produced the following patents, some of which may be relevant to the present invention: Buzick, U.S. Pat. No. 2,914,809, issued Dec. 1, 1959; Hurdt, U.S. Pat. No. 3,324,513, issued Jun. 13, 1967; Mangialardi et al., U.S. Pat. No. 3,392,424, issued Jul. 16, 1968; Jackson, U.S. Pat. No. 4,103,397, issued Aug. 1, 1978; Vandergriff, U.S. Pat. No. 4,140,503, issued Feb. 20, 1979; Woods, U.S. Pat. No. 4,726,096, issued Feb. 23, 1988; and Vandergriff, U.S. Pat. No. 5,381,587, issued Jan. 17, 1995.

None of known prior art, either singly or in combination, disclose or suggest the present invention.

BRIEF SUMMARY OF THE INVENTION

The present invention includes an apparatus and method for restoring moisture to lint cotton in a cotton gin. The concept of the present invention is to precisely adjust the moisture content of lint cotton at a lint slide based on the final moisture desired in the bale, the volume of lint cotton present (i.e., the ginning rate), and, depending on the model or mode of the present invention, the moisture present in the lint cotton before adding moisture. The present invention applies moisture to the lint cotton on the lint slide prior to entering the press. In the automatic mode of the present invention, the amount of moisture applied is determined by measuring the moisture in the lint cotton as it leaves the battery condenser (preferably using an infrared moisture measuring sensor or the like), subtracting the value of that measured incoming moisture from the desired final moisture of the finished bale, and then multiplying the difference by the rate of ginning in bales per second, resulting in the percent of moisture to be added per second to the lint cotton between the battery condenser and bale press. This data is used by the present invention to deliver a very accurately metered volume of moisture to each bale, resulting in a finished bale with the desired final moisture content, regardless of the incoming moisture or the rate of ginning.

The apparatus of the present invention includes, in general, rate measuring means for measuring the rate of lint cotton exiting a battery condenser; moisture adding means for adding a precise amount of moisture to the lint cotton between the battery condenser and a bale press based on the desired moisture content of the cotton bale, and the rate of lint cotton exiting the battery condenser; and, perhaps, moisture content measuring means for measuring the moisture content of the lint cotton as it leaves the battery condenser.

The method of the present invention includes, in general, the steps of measuring the rate of lint cotton exiting a battery condenser; adding a precise amount of moisture to the lint cotton between the battery condenser and a bale press based on the desired moisture content of the cotton bale, and the rate of lint cotton exiting the battery condenser; and, perhaps, measuring the moisture content of the lint cotton as it leaves the battery condenser.

One object of the present invention is to provide an accurate apparatus and method for adding a precise amount of moisture to lint cotton before the lint is tramped into a cotton bale.

Another object of the present invention is to provide an automatic model by adding a controlled and variable amount of moisture to lint cotton as it moves from the battery condenser down the lint slide on the way to the bale press based on, in part, the incoming moisture of the lint cotton (i.e., the moisture content of the lint cotton as it enters the lint slide, before moisture is added thereto) to result in a finished bale moisture equal to a final bale percent moisture dial setting or the like as set by gin management.

Another object of the present invention is to provide a manual model by adding a preset amount of moisture to each bale as the lint cotton moves down the lint slide on the way to the bale press, resulting in a finished bale that has had the percent of moisture selected on the moisture to add dial setting (set by gin management) added to the bale, regardless of the incoming moisture of the lint cotton.

DETAILED DESCRIPTION OF THE INVENTION

Figure 1:
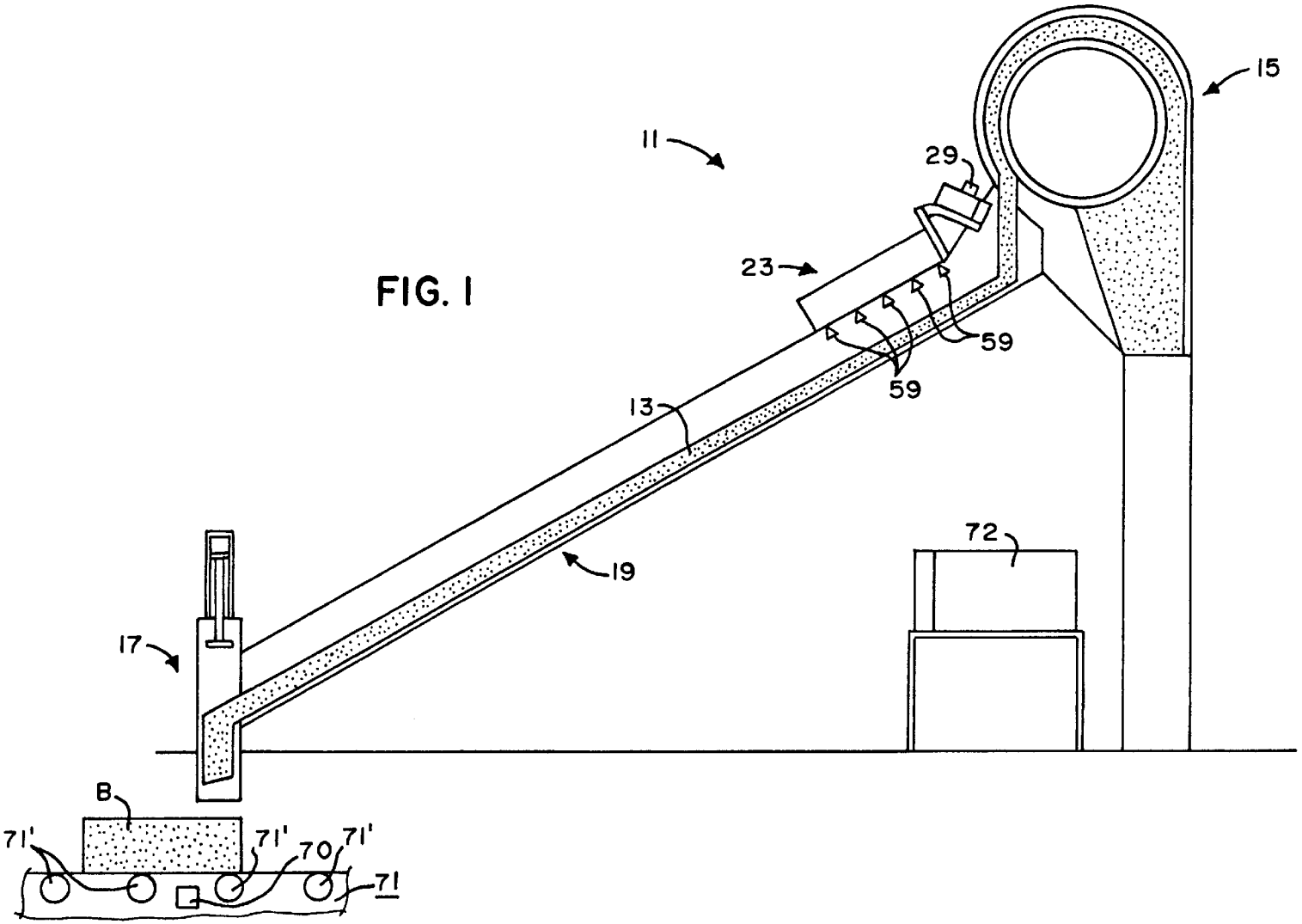
FIG. 1 is a somewhat diagrammatic elevational view of the apparatus of the present invention, shown in combination with a battery condenser, bale press and lint slide of a cotton gin.

A preferred embodiment of the apparatus of the present invention is shown in the drawings and identified by the numeral 11. The apparatus 11 of the present invention is designed to restore moisture to lint cotton 13 passing from a battery condenser 15 to a bale press 17 down a lint slide 19 in a typical cotton gin.

The apparatus 11 includes a rate measuring means 21 for measuring the rate of lint cotton 13 exiting the battery condenser 15, and a moisture adding means 23 for adding a precise amount of moisture to the lint cotton 13 between the battery condenser 15 and the bale press 17 based on the desired moisture content of the cotton bale B as set by gin management, etc., and the rate of lint cotton 13 exiting the battery condenser 15 as measured by the rate measuring means 21.

The apparatus 11 preferably includes incoming moisture content measuring means 25 for measuring the moisture content of the lint cotton 13 as it leaves the battery condenser 15 for allowing the apparatus 11 to operate in an automatic model or mode to adding a precise amount of moisture to the lint cotton 13 between the battery condenser 15 and the bale press 17 based on the desired moisture content of the cotton bale B as set by gin management, etc., and the rate of lint cotton 13 exiting the battery condenser 15 as measured by the rate measuring means 21, and the moisture content of the lint cotton 13 as it leaves the battery condenser 15 as measured by the incoming moisture content measuring means 25.

The apparatus 11 preferably includes a programmable logic controller (PLC) 27 for monitoring and controlling the means 21, 23, 25, etc.

The moisture content measuring means 25 sends a signal 28 to the PLC 27 which can be scaled by the PLC 27 to determine the moisture content of the lint cotton 13. The moisture content measuring means 25 preferably includes an infrared (IR) sensor 29. The IR sensor 29 is preferably a near infrared (NIR) sensor. The moisture content measuring means 25 may consist of a Moisture Register Products Smart II NIR Moisture Measuring System marketed by Moisture Register Products, a division of Aqua Measure Instrument Co., 1712 Earhart Court, La Verne, Calif. 91750-0369.

The rate measured by the rate measuring means 21, typically referred to as the "ginning rate" of the gin, can be determined by several different mechanisms depending upon which is the most practical for the specific individual ginning system.

In a first embodiment, the rate measuring means 21 could include dual potentiometers to replace the typical speed potentiometer on the gin feeder, feed rollers controller. That is, one of the dual potentiometers will provide the feed roller speed input signal, and the other of the dual potentiometers, in conjunction with a 10 volt D.C. power supply or the like, will give an analog input (i.e., signal 30 as shown in FIG. 2) to the PLC 27 which can be scaled by the PLC 27 to determine the ginning rate of the gin stand.

Figure 2:
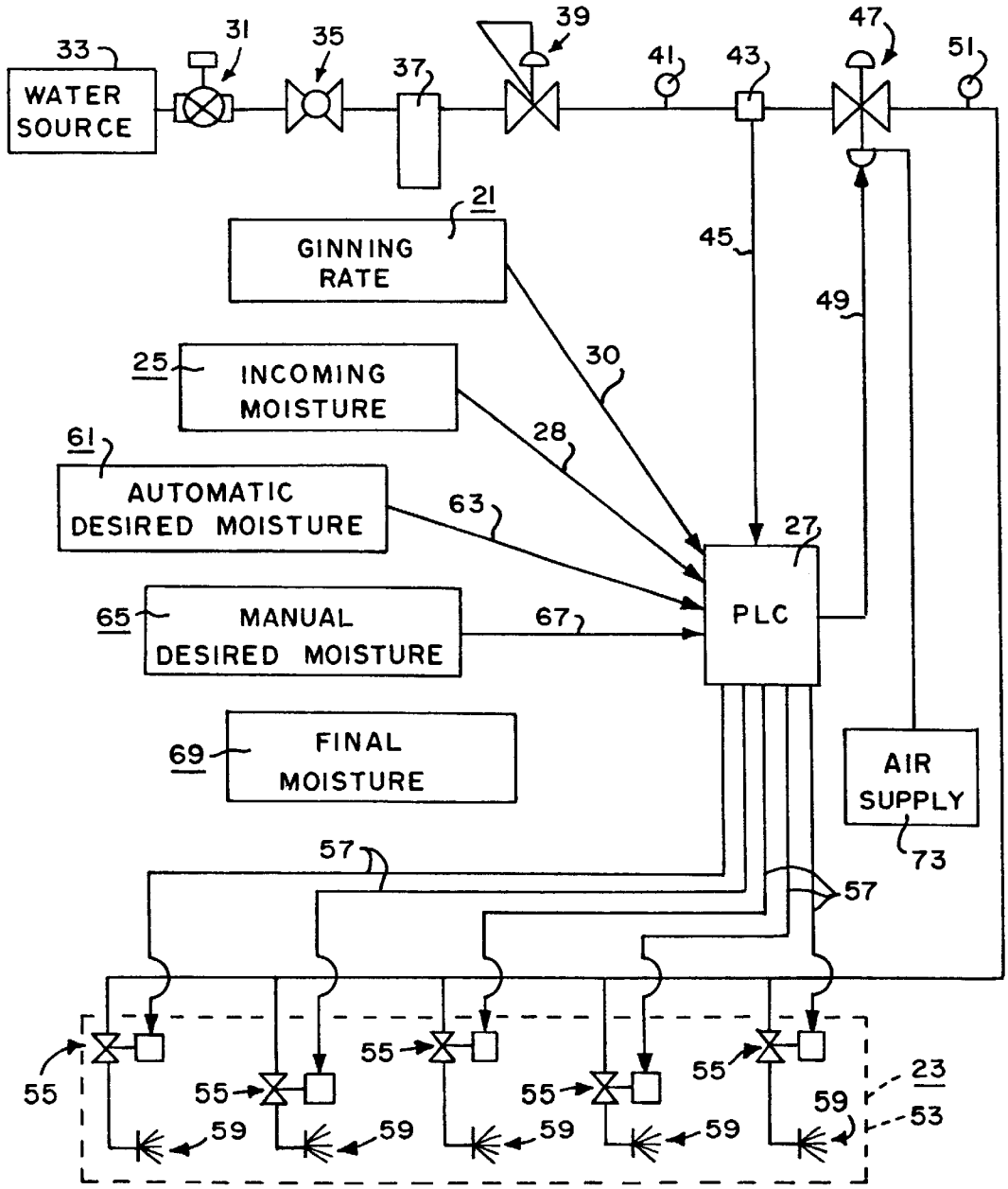
FIG. 2 is a block diagram of the apparatus of the present invention.
Figure 3A:
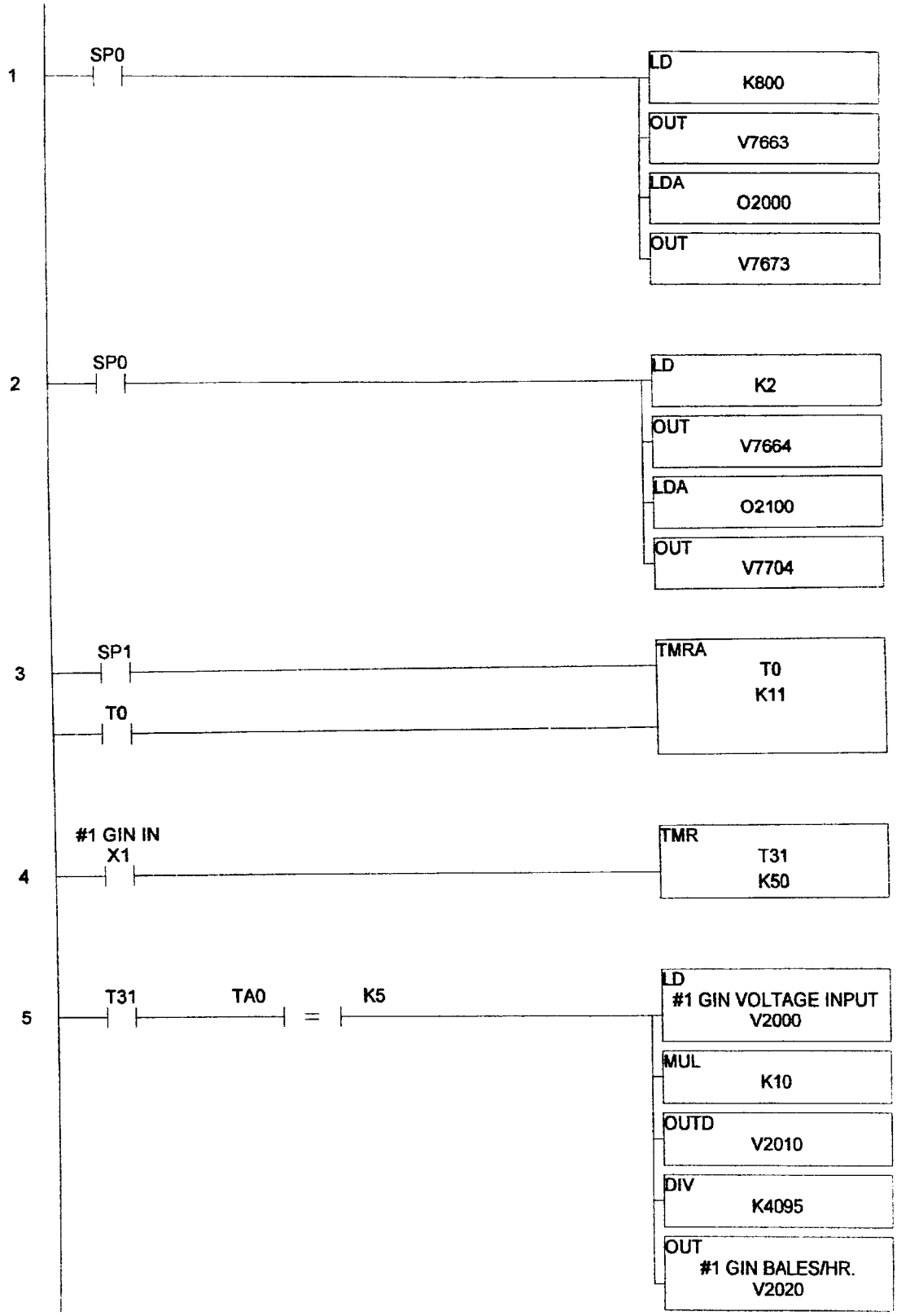
FIGS. 3A–3S, taken together and arranged as shown in FIG. 3, disclose a preferred program for controlling the programmable logic controller of the apparatus of the present invention based on, for example, a three gin stand system.
Figure 3B:
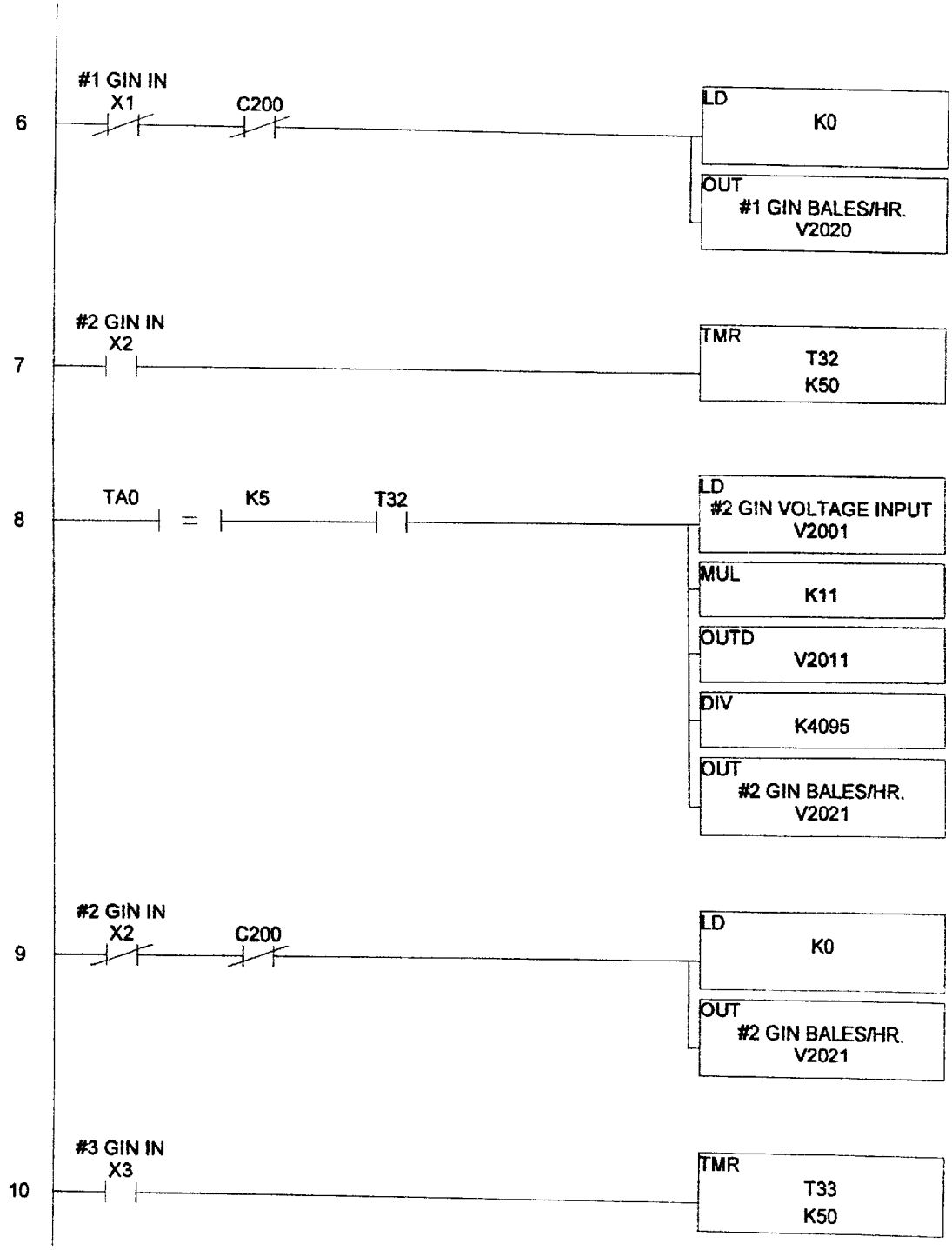
FIG. 3 is a diagram showing the arrangement of FIGS. 3A–3S.
Figure 3C:
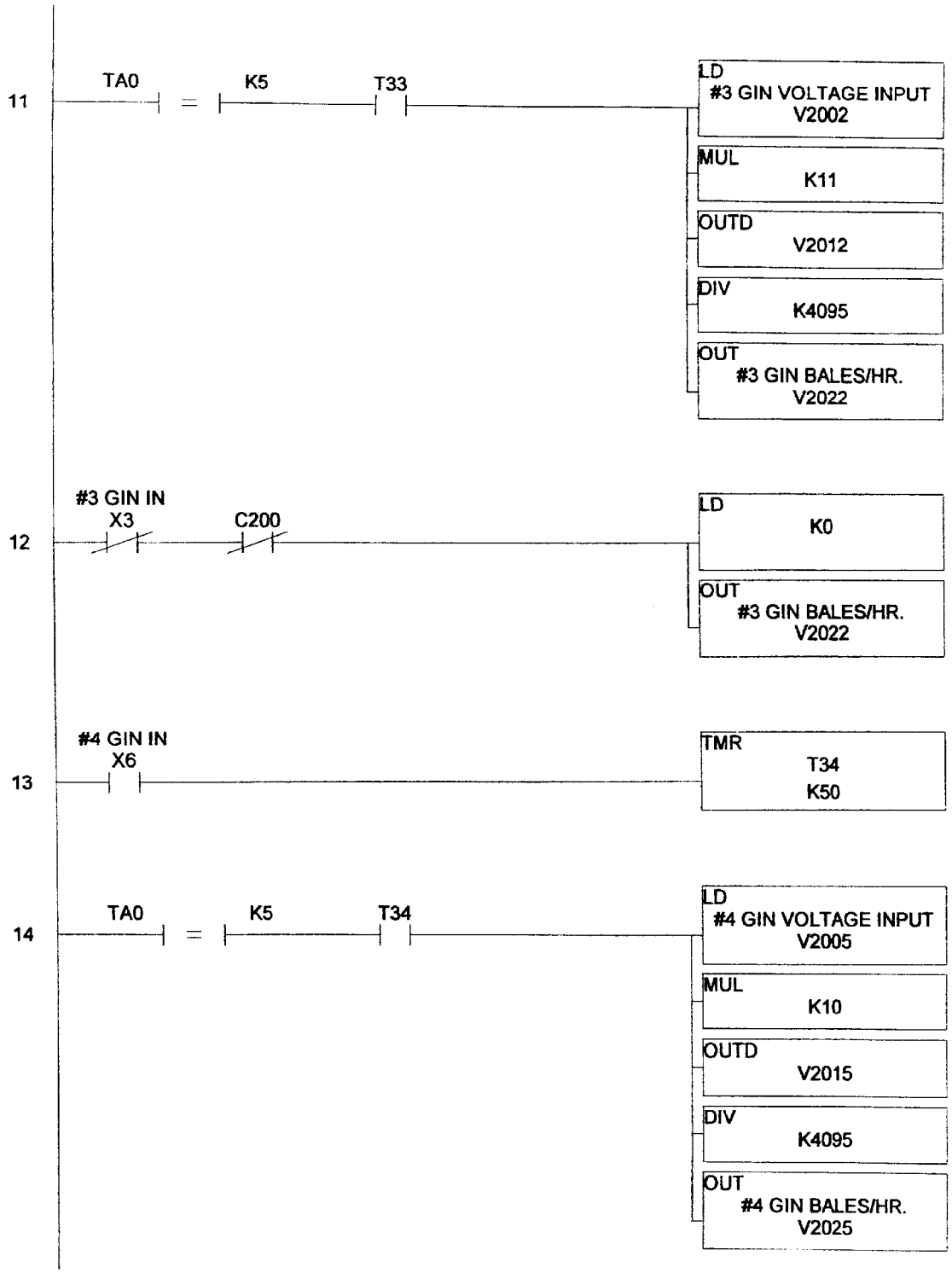
Figure 3D:
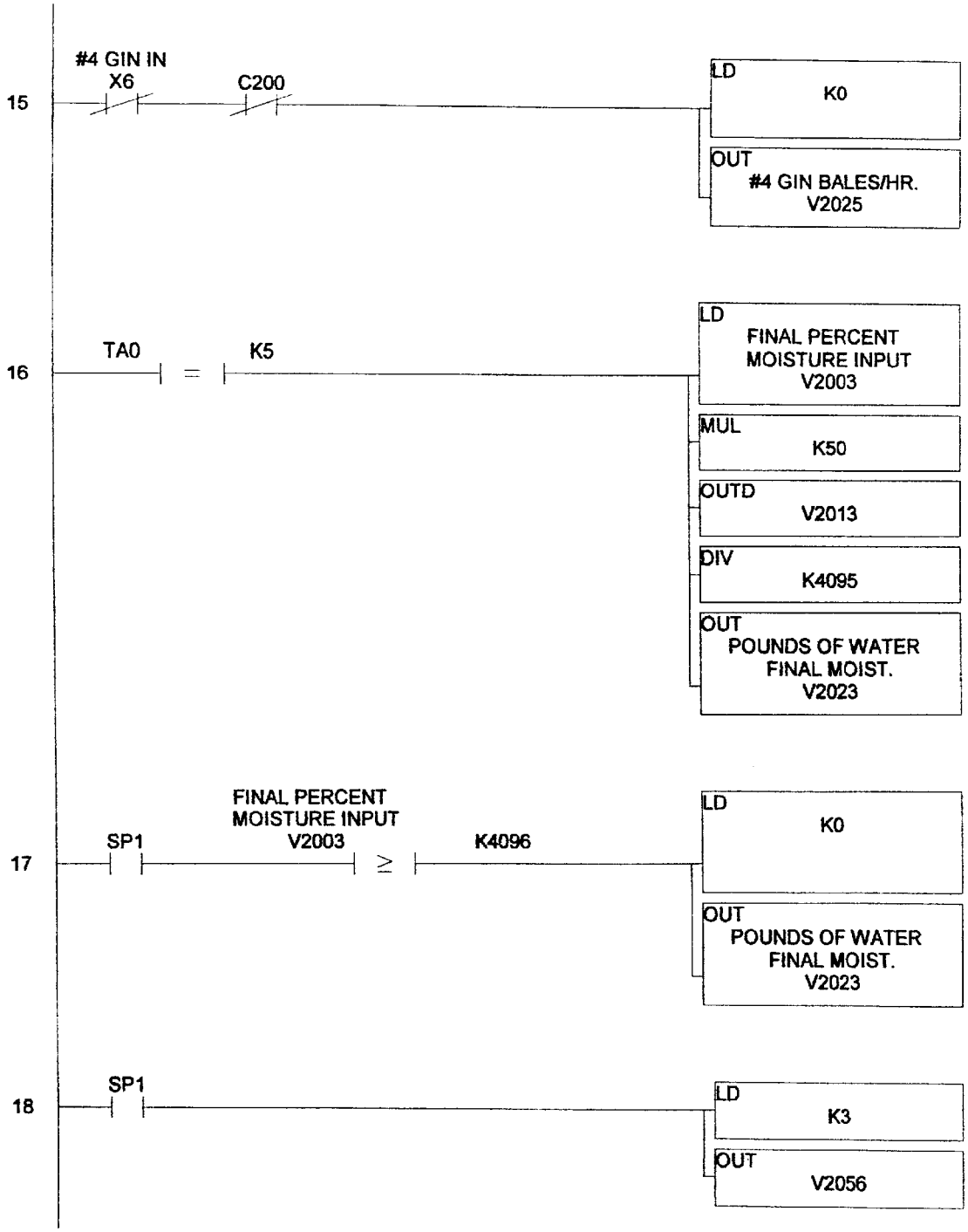
Figure 3E:
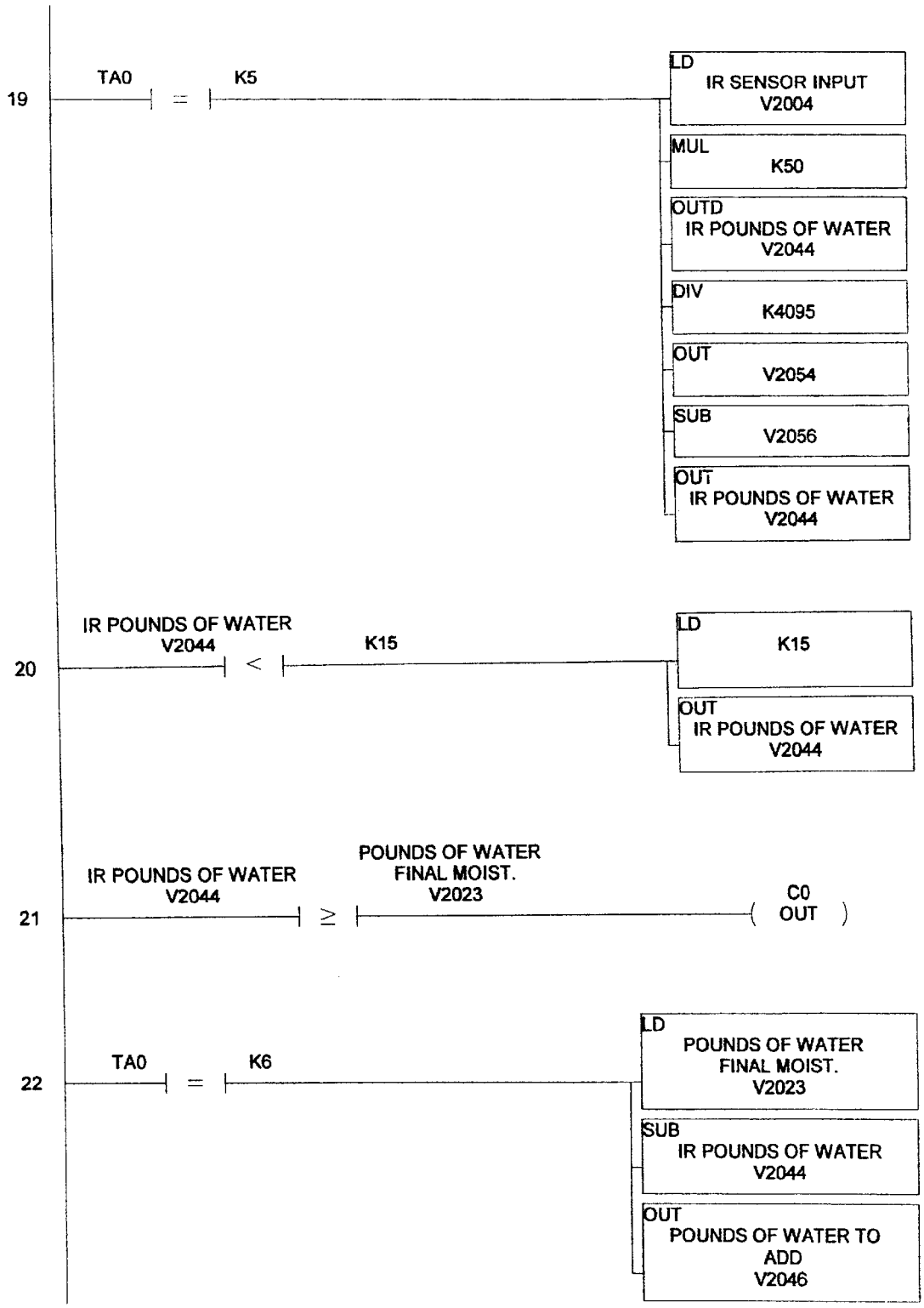
Figure 3F:
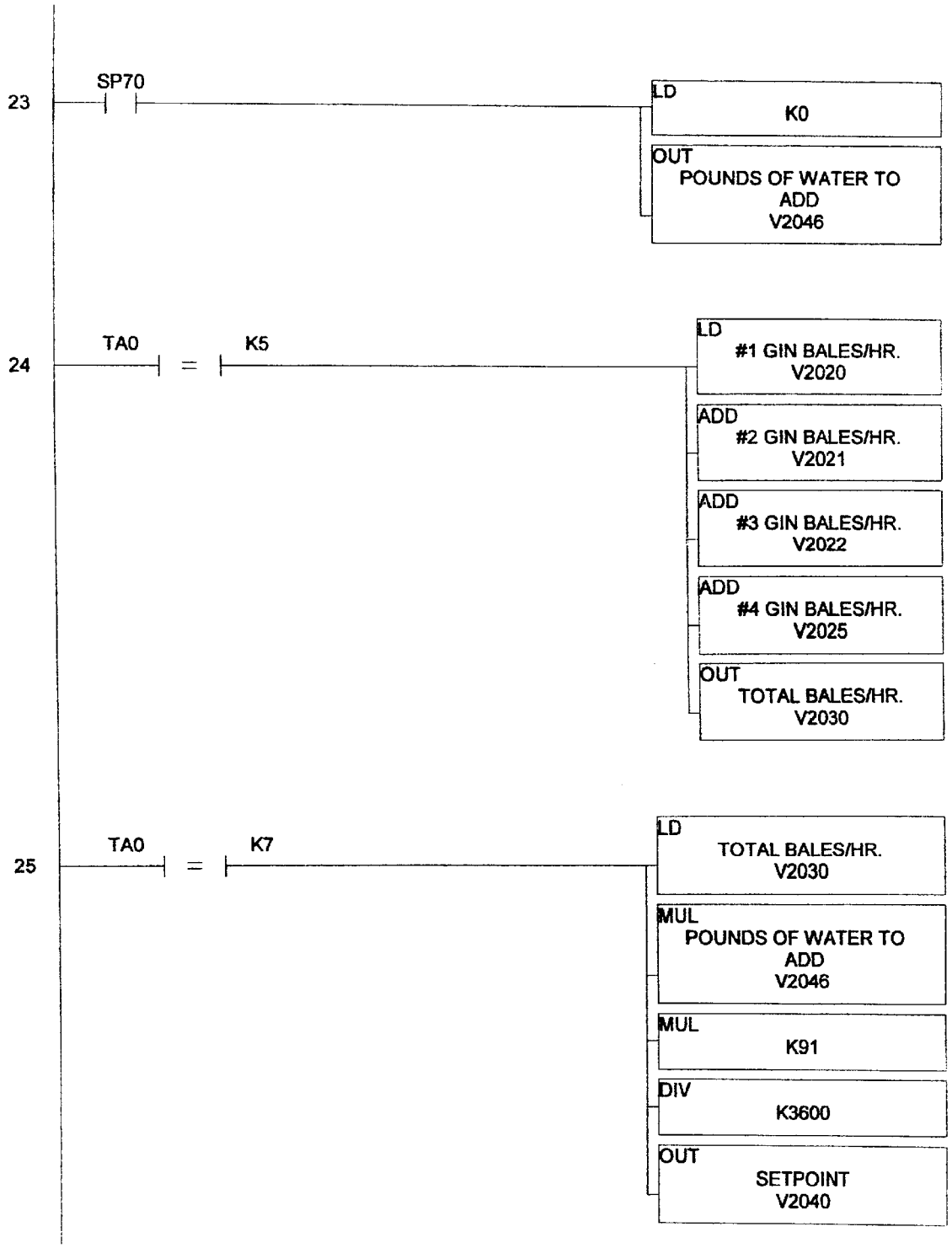
Figure 3G:
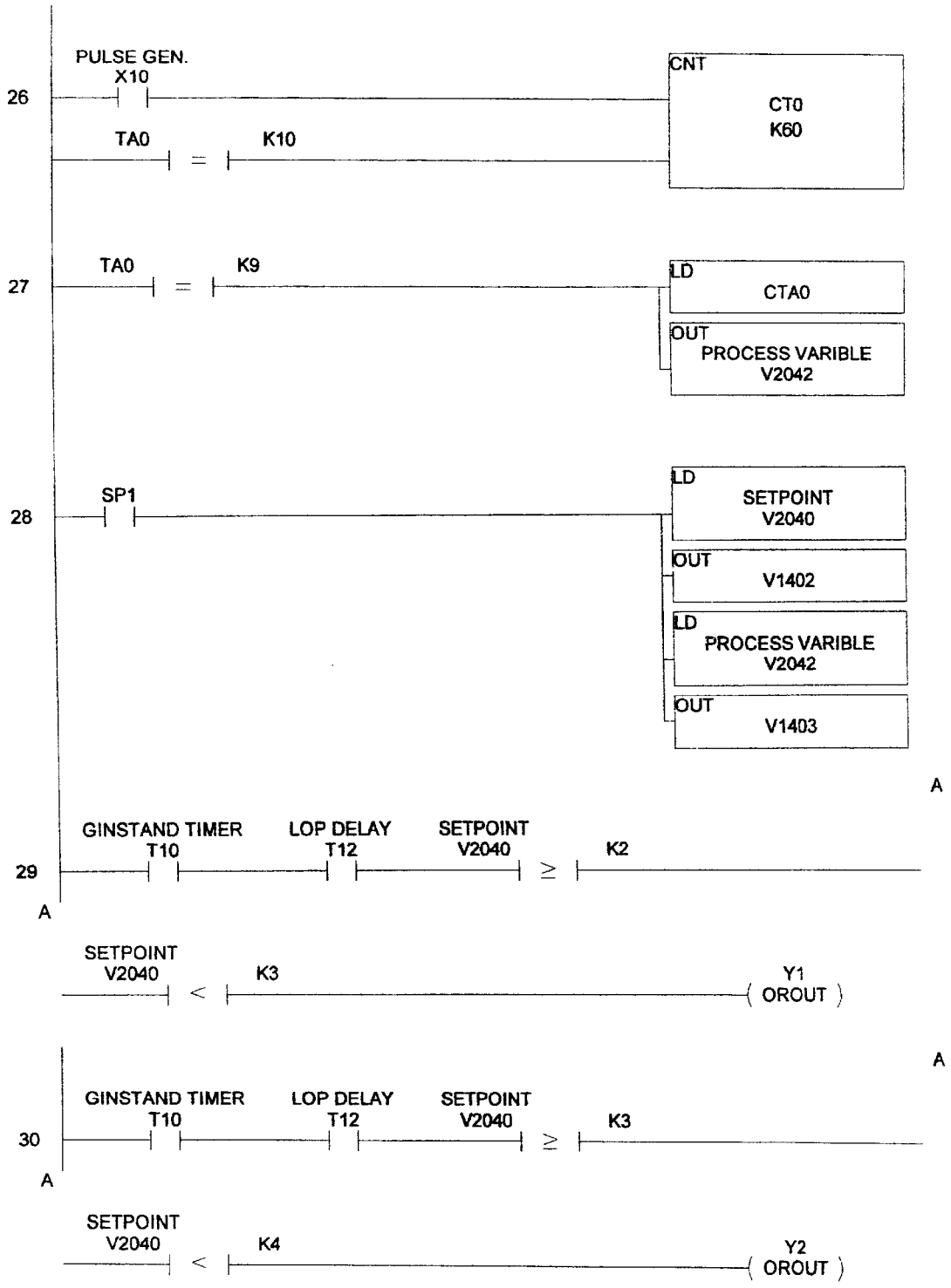
Figure 3H:
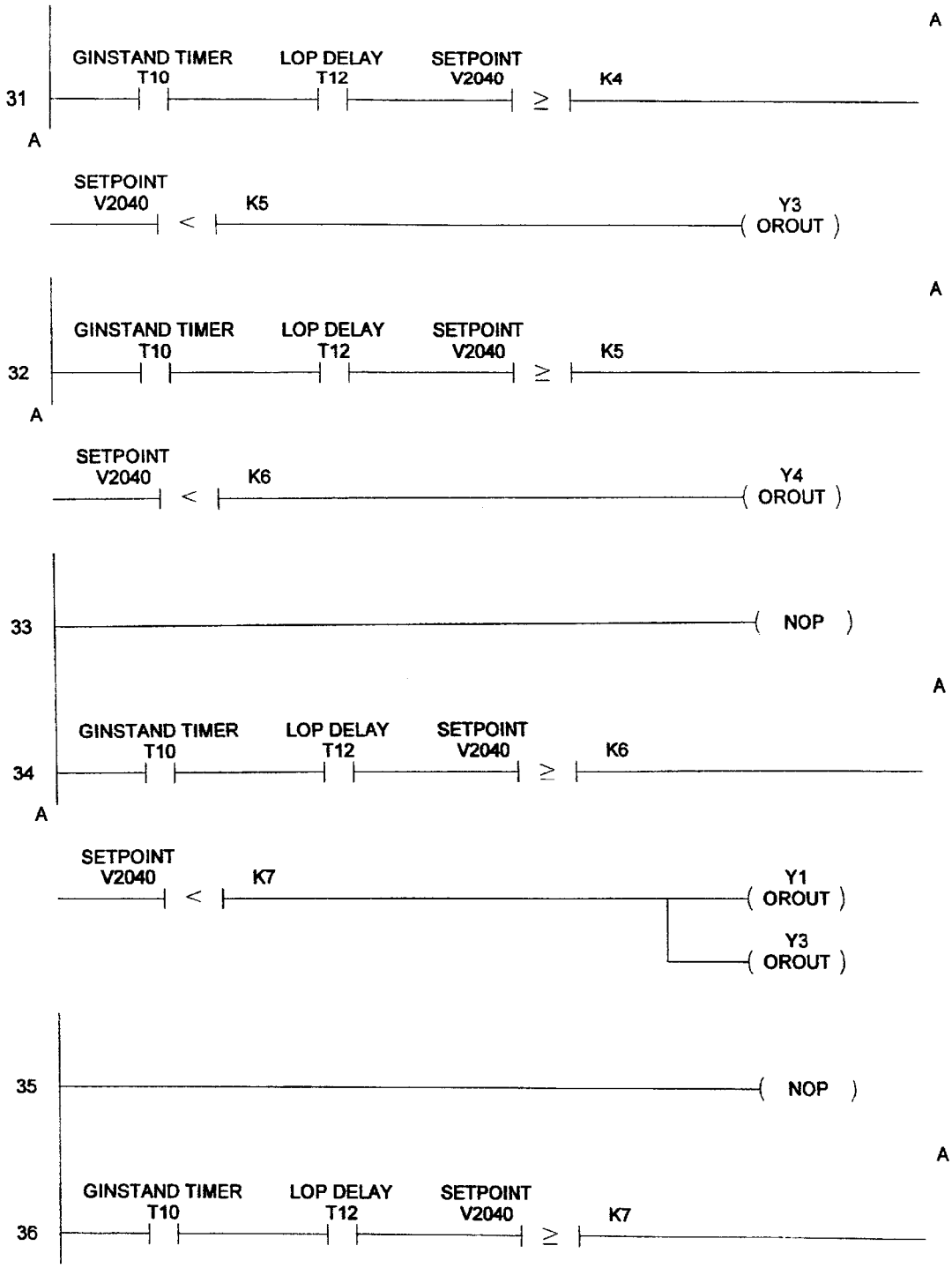
Figure 3I:
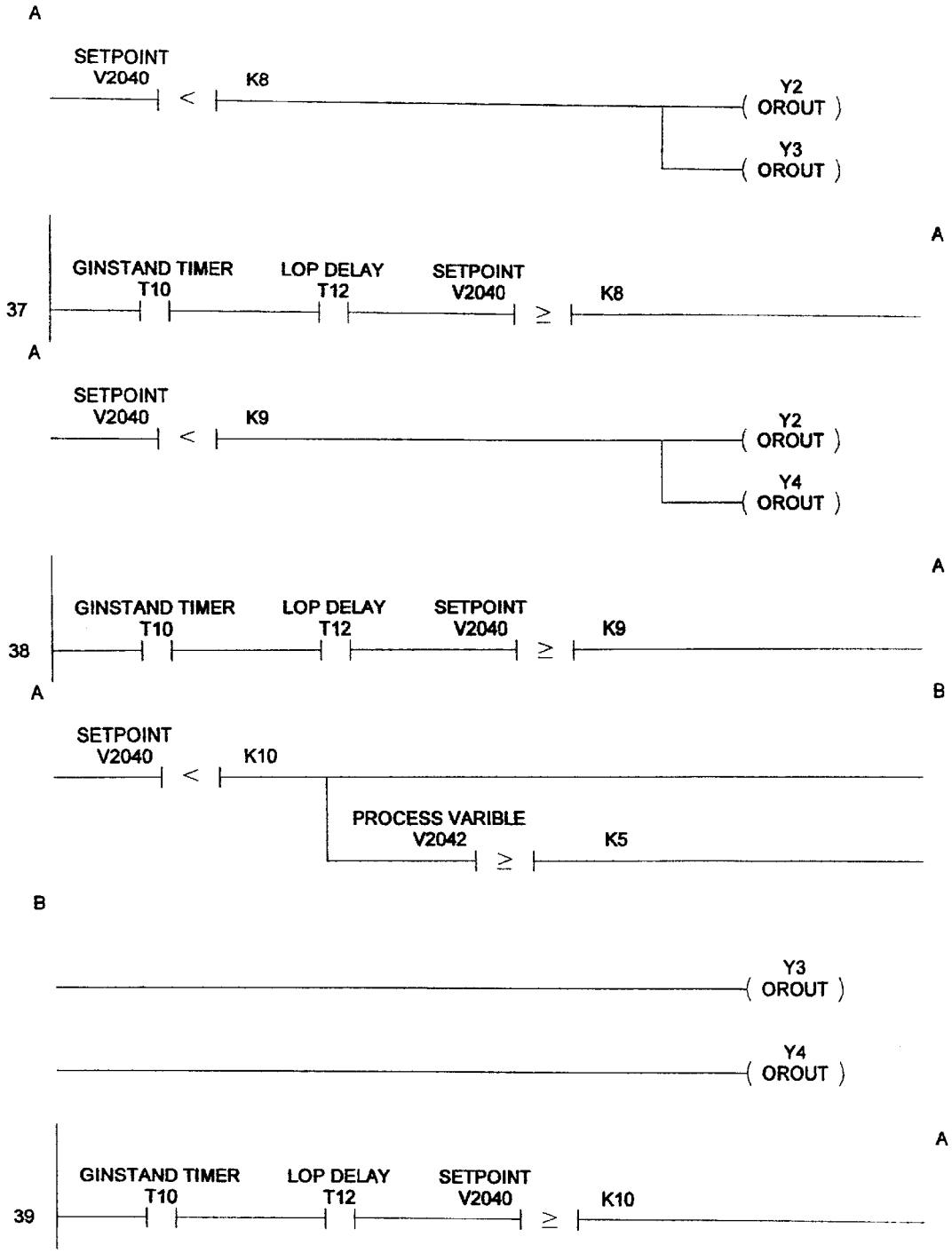
Figure 3J:
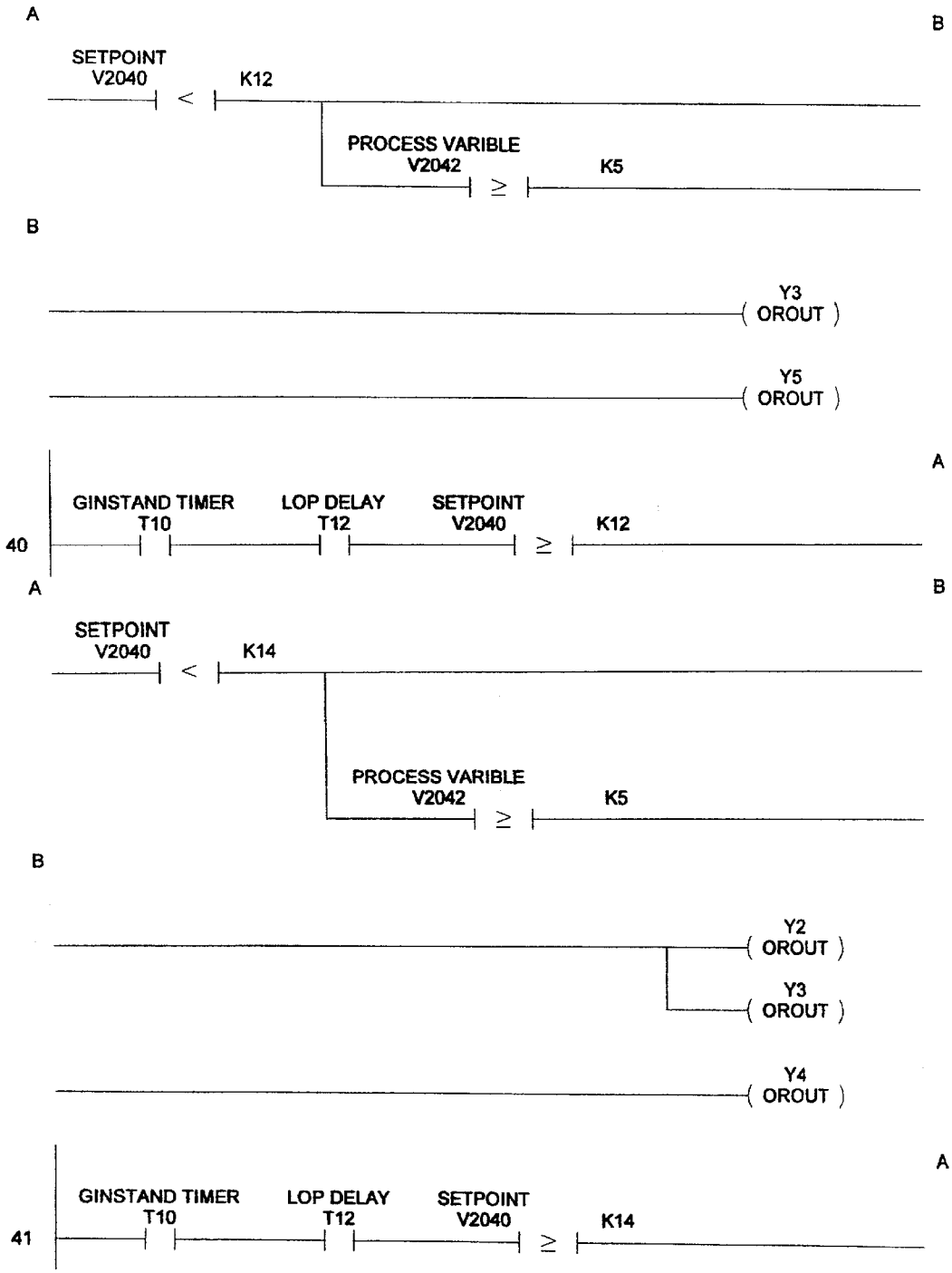
Figure 3K:
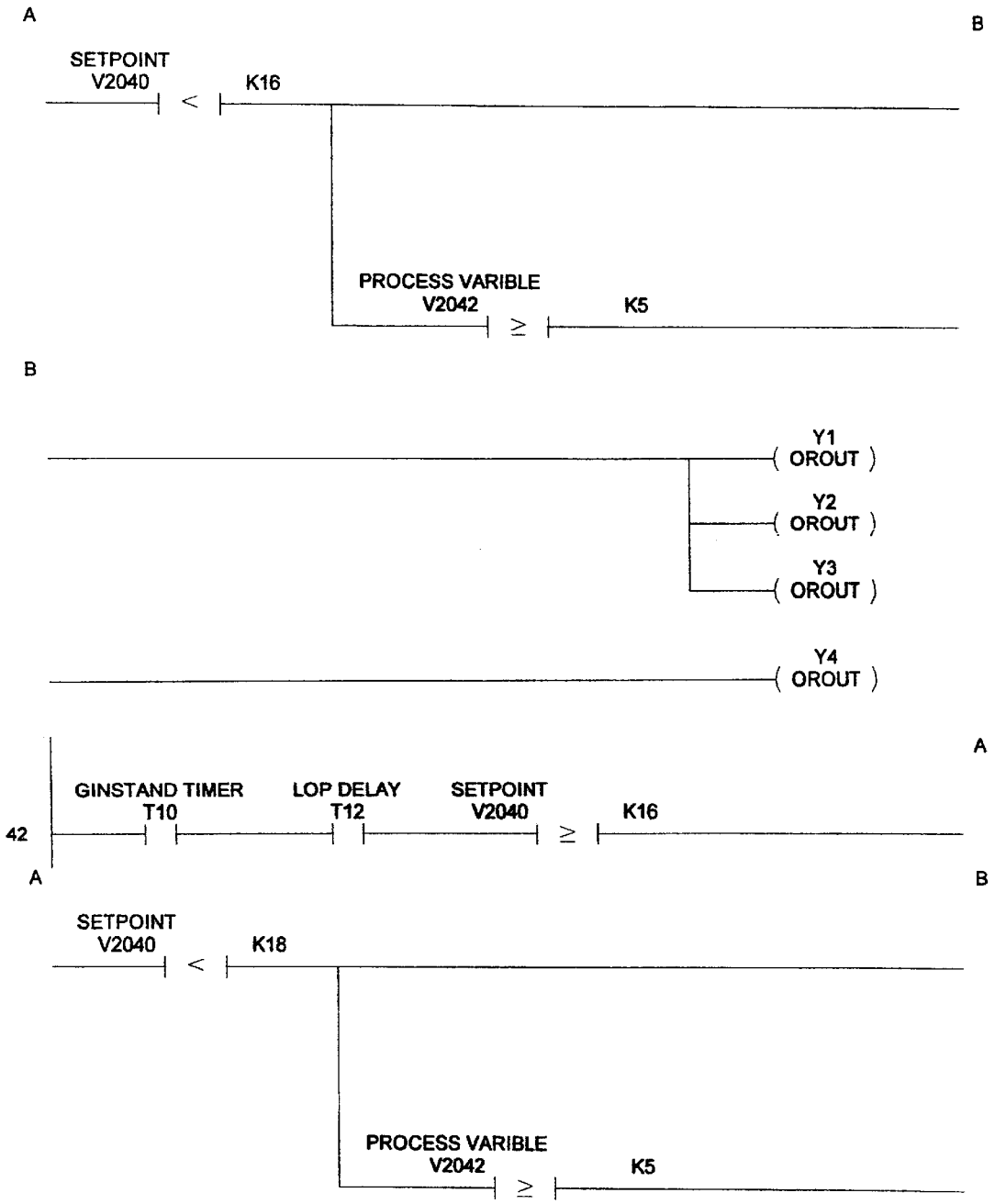
Figure 3L:
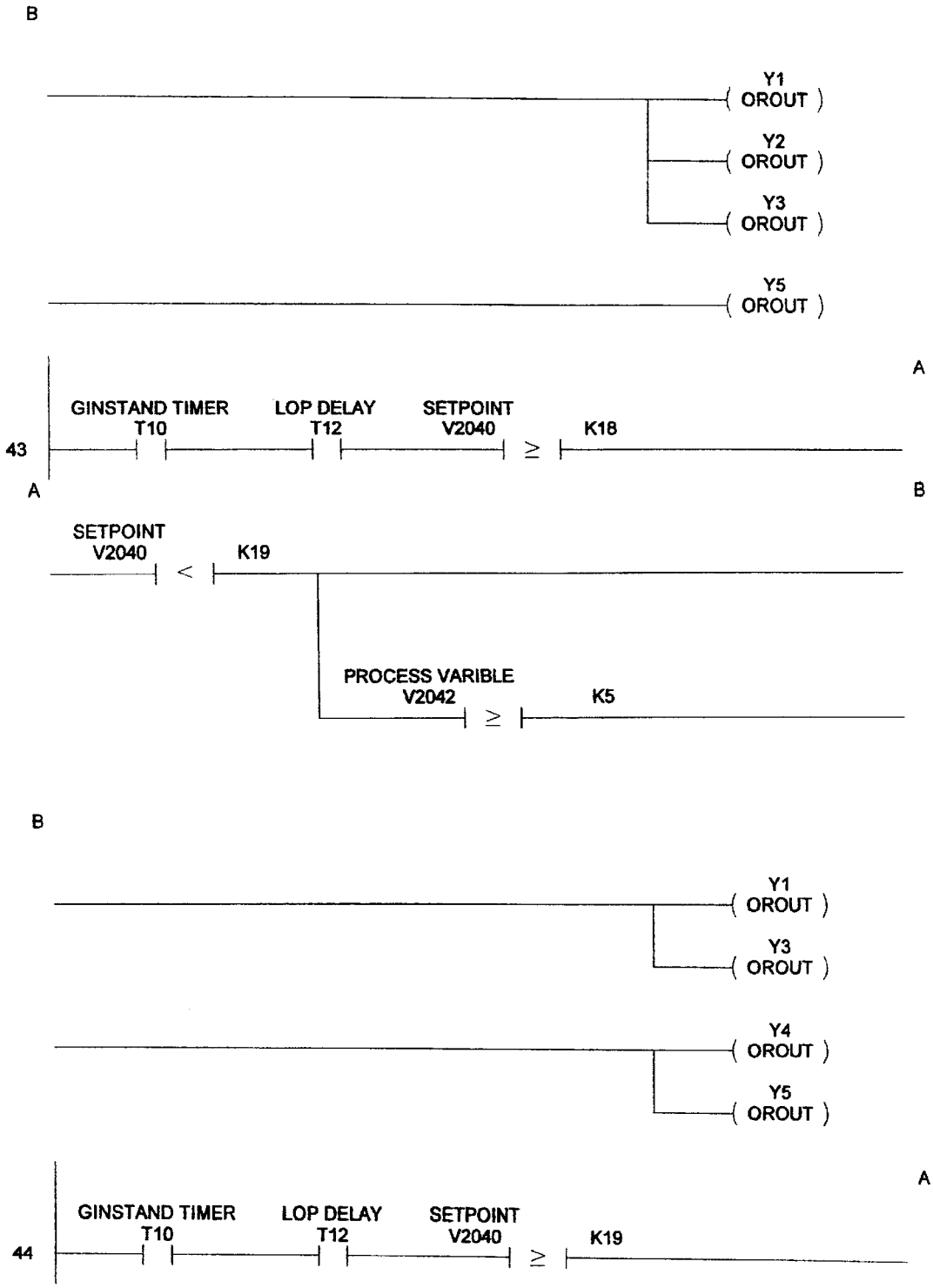
Figure 3M:
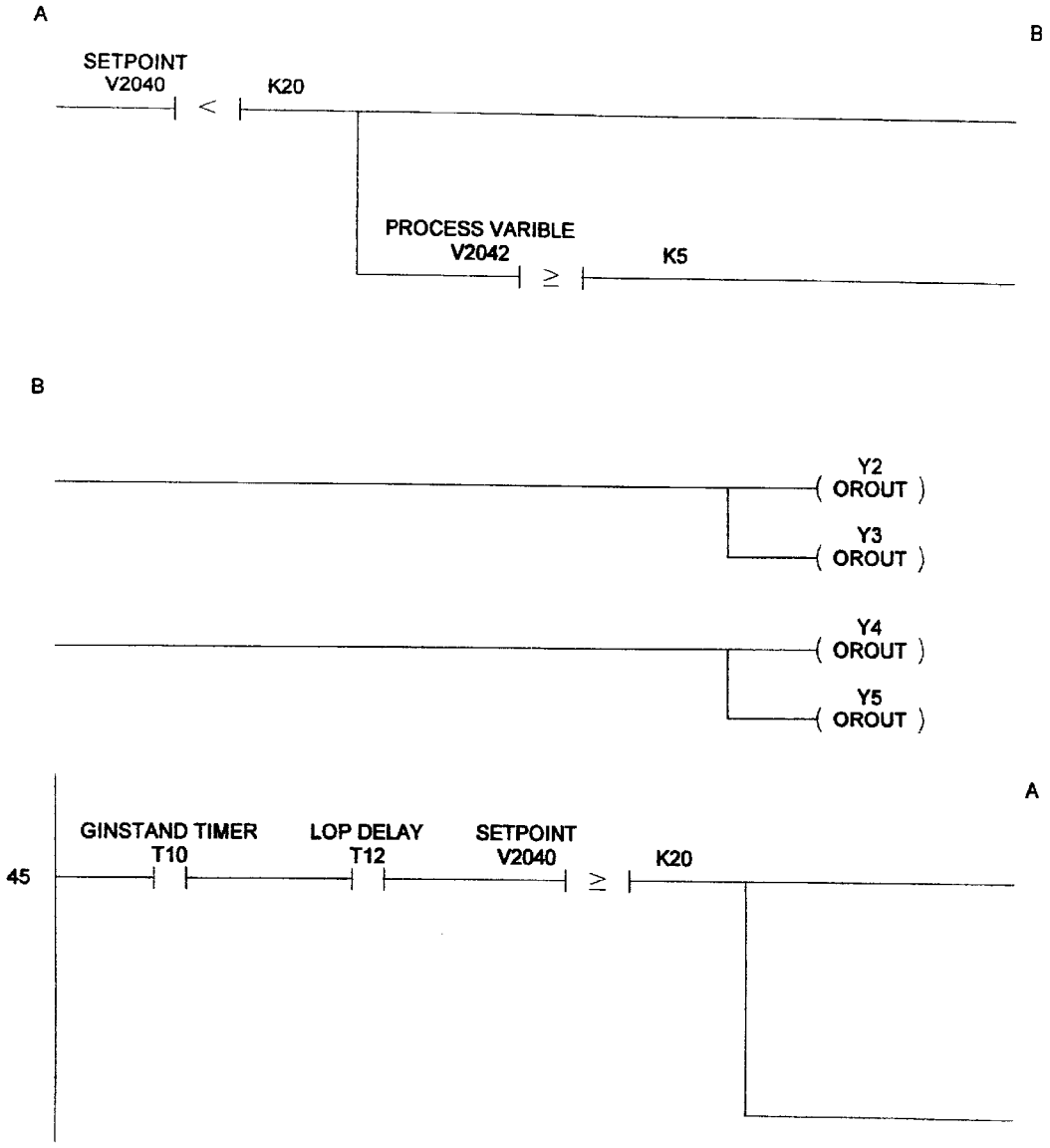
Figure 3N:
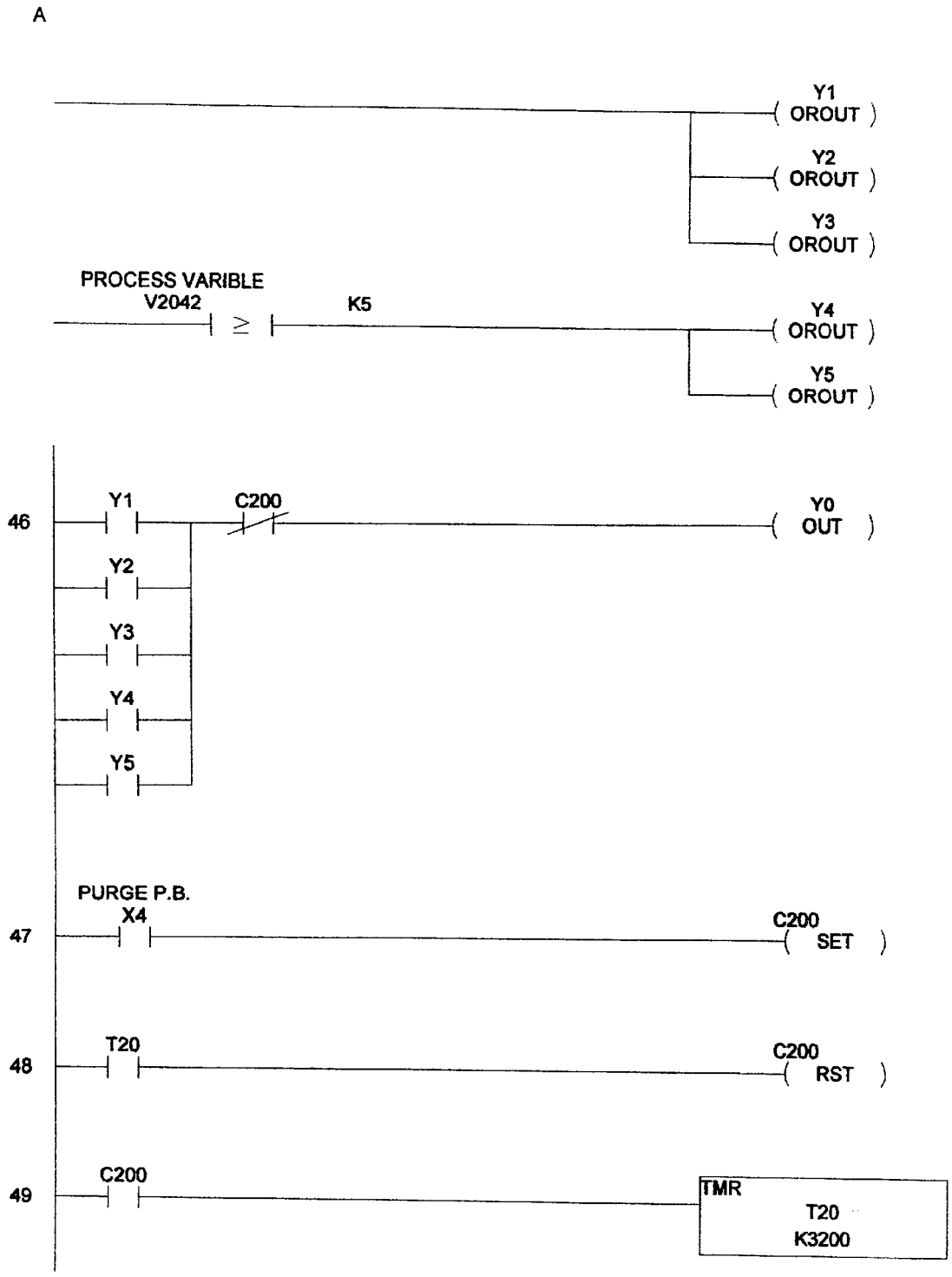
Figure 3O:
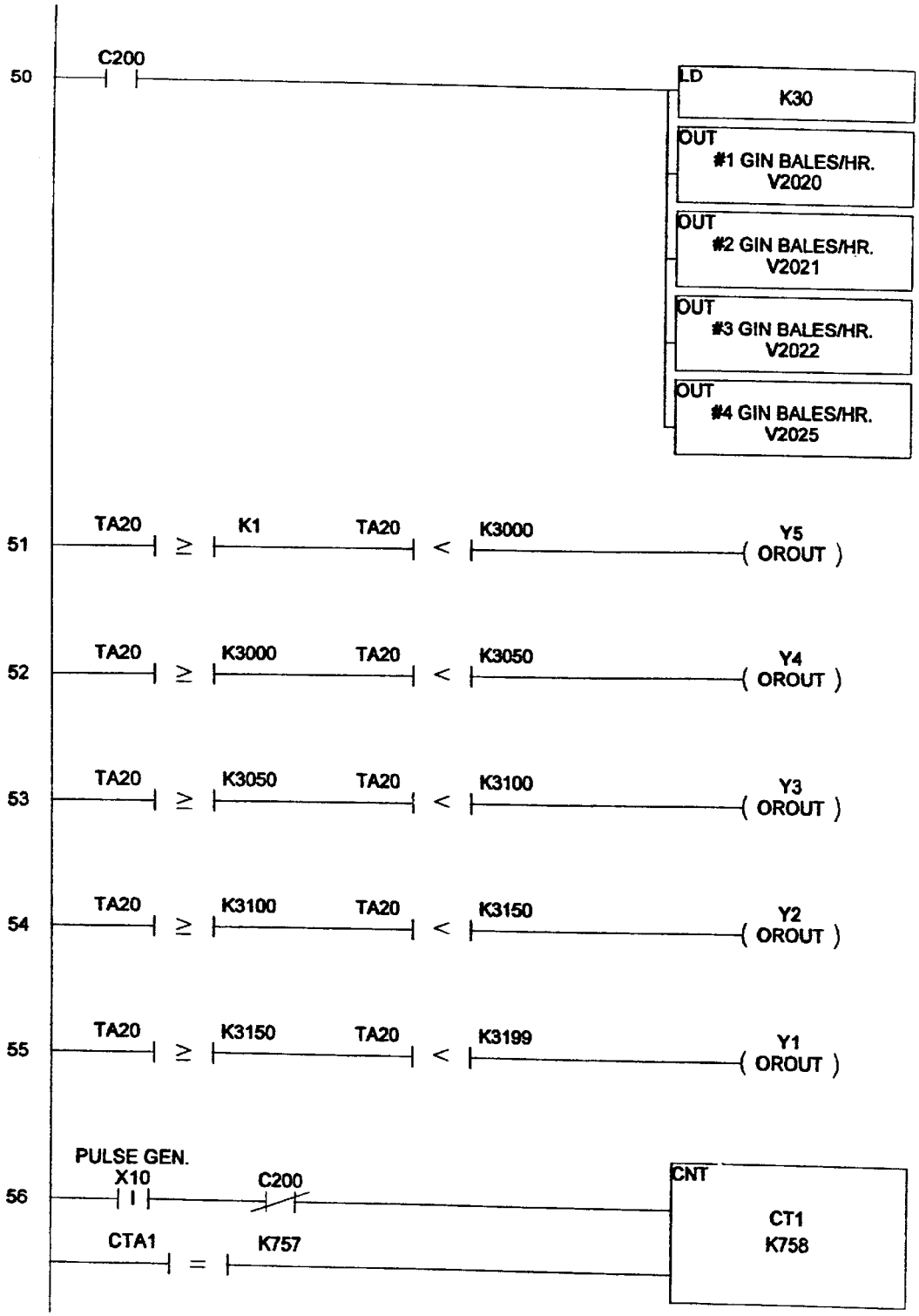
Figure 3P:
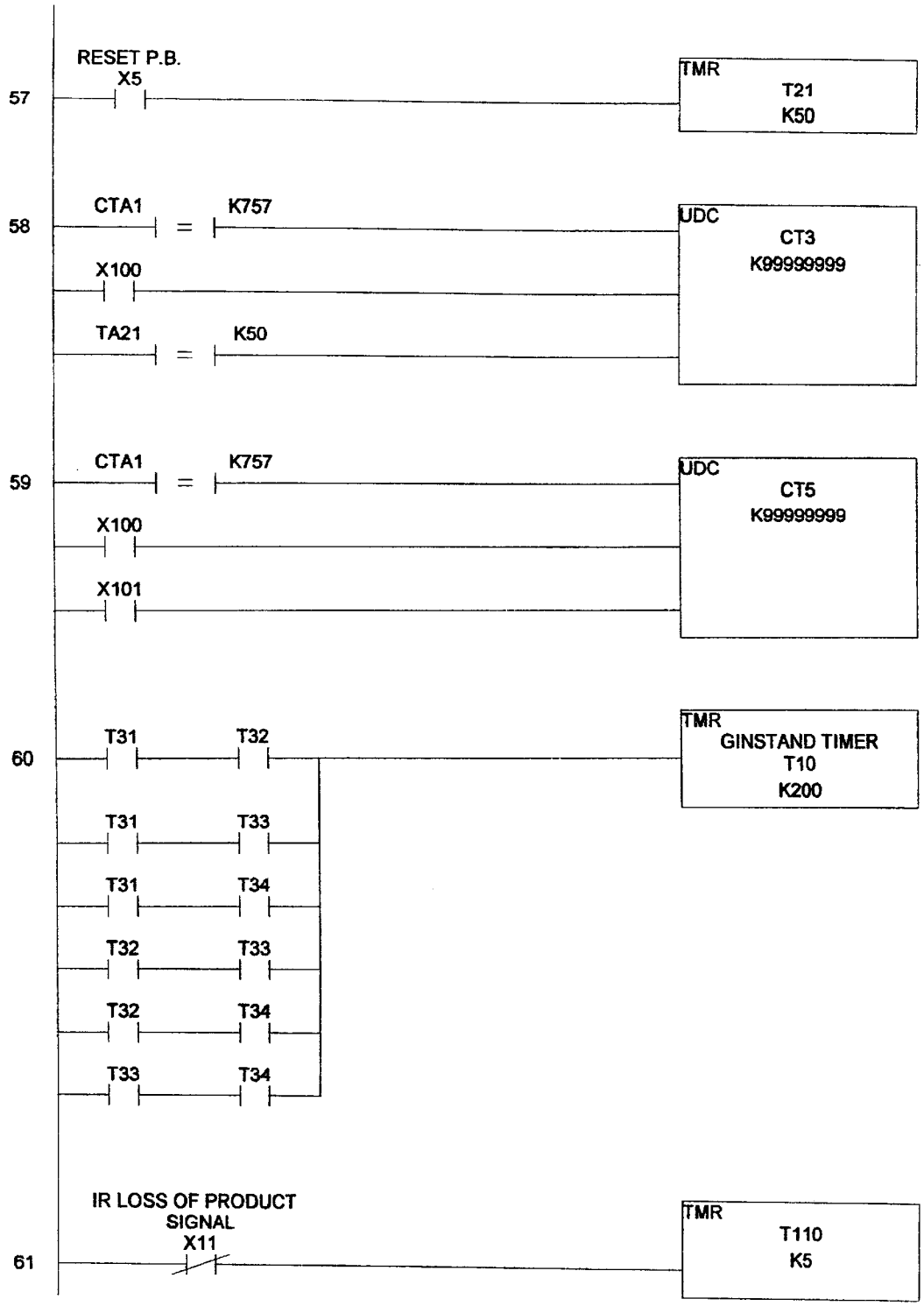
Figure 3Q:
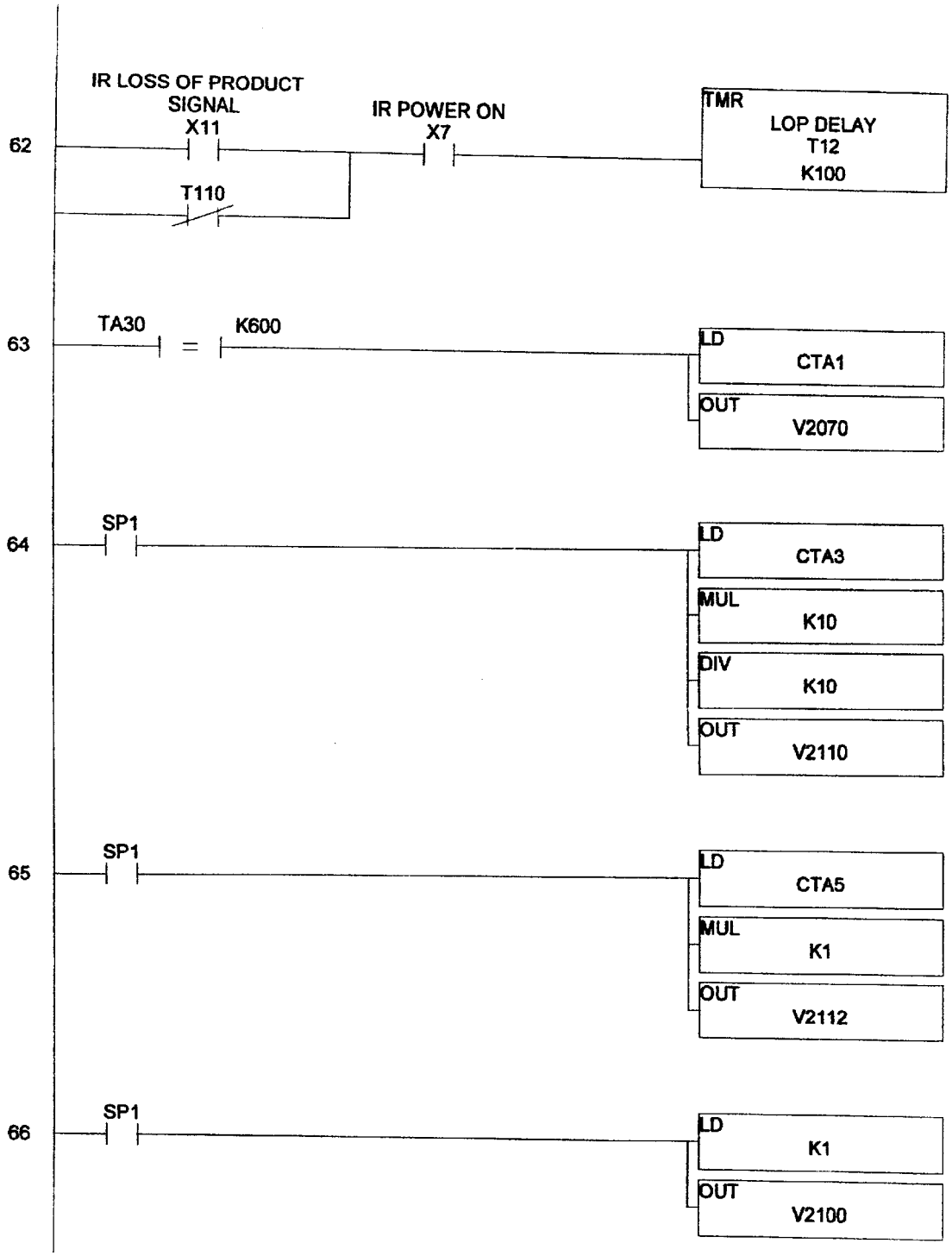
Figure 3R:
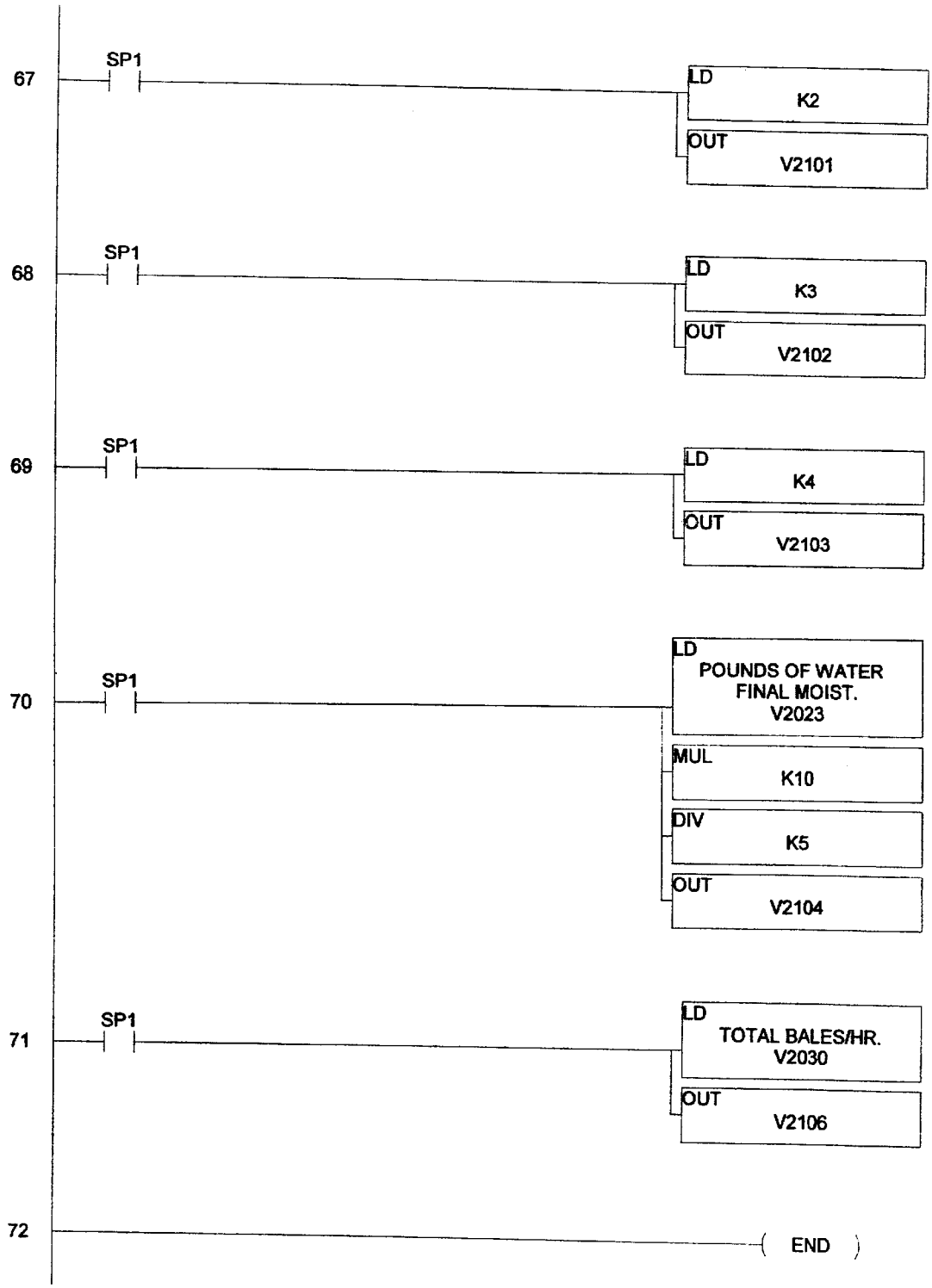
Figure 3S:
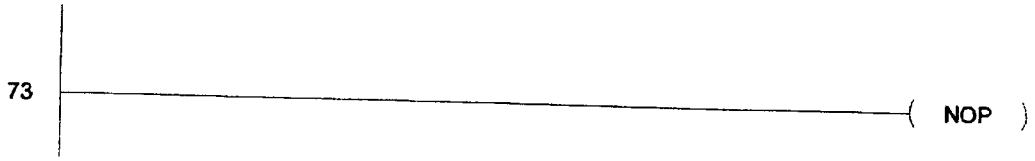

In a second embodiment, the rate measuring means 21 could include a DC/DC transducer connected directly to the speed potentiometer of the gin feeder feed roller controller (the controller can be DC or AC invertor), with the output of the transducer (i.e., signal 30 as shown in FIG. 2) connected to the analog input on the PLC 27 so the PLC 27 can scale the analog input to determine the ginning rate.

In a third embodiment, a DC/DC transducer can be connected across the DC controllers armature voltage, usually denoted as Al and A2. The output of the transducer (i.e., signal 30 as shown in FIG. 2) is connected to the analog input on the PLC 27 so that the PLC 27 can scale the analog input to determine the ginning rate.

In a fourth embodiment, the rate measuring means 21 could include a DC sensor (e.g., an inductive proximity switch such as a Censtable AM series M12 DC inductive proximity switch, Model AM1-AN14A) used to count the teeth on the feeder roller shaft. By sending a DC pulse (i.e., signal 30 as shown in FIG. 2) to the PLC 27 as each tooth passes by the sensor, the speed of the lint cotton 13 exiting the battery condenser 15 can be determined by the PLC 27.

The moisture adding means 23 of the apparatus 11 preferably includes a booster pump 31 coupled to an external water source 33 (e.g., a public water utility or private water system) for raising the water pressure of the water source 33 to over 50 PSI (pounds per square inch). Discharge from the booster pump 31 is connected to a ball valve 35 used to shut off the water flow when needed or desired. When the ball valve 35 is open (turned on), the pressurized water passes through a five micron filter 37 into a type B pressure regulator 39 used to control the discharge pressure to 50 PSI. A pressure gauge 41 is preferably located directly downstream of the pressure regulator 39 for displaying the controlled discharge pressure. From the pressure gauge 41, the water passes a flow meter 43 where a DC pulse signal 45 of 182 pulses per pound of water is sent to the input module on the PLC 27. After passing the flow meter 43, the water enters a flow control valve 47 where the flow rate is controlled by the PLC 27 so that the desired amount of water will be discharged through the flow control valve 47. A pressure gauge 51 is preferably located directly downstream of the flow control valve 47 for displaying the back pressure on the flow control valve 47 produced by a spray nozzle assembly 53. The spray nozzle assembly 53 includes up to five solenoid valves 55 that are controlled by signals 57 from the PLC 27, and a spray nozzle 59 associated with each solenoid valve 55. The solenoid valves 55 maintain the back pressure needed to maintain a full spray pattern from each spray nozzle 59. The apparatus 11 preferably includes five nozzles 59 aligned one behind the other above the batt (lint cotton 13) on the lint slide 19, parallel to the lint slide 19. To be certain the fan of spray leaving the nozzles 59 is of a constant width, the pressure preferably always remains at 40 pounds per square inch. Rather than pressure adjustment, nozzles 59 with orifices sizes sufficient to spray in a range of 0.1 gallon at 40 pounds per square inch to 0.5 gallon at 40 pounds per square inch, can be combined instantaneously in order to achieve the desired spray pattern. Thus, each nozzle 59 is coupled to one solenoid valve 55 to permit the nozzle combinations to change according to commands from the PLC 27. The various components 31, 33, 35, 37, 39, 41, 43, 47, 51, 55 and 59 are preferably joined together in a fluid-tight manner by standard ½ inch water pipe or the like.

The apparatus 11 preferably includes a desired moisture control means 61 for being set by gin management, etc., to send a signal 63 to the PLC 27, when the apparatus 11 is running in the automatic mode or model, to identify the desired final moisture content of the lint cotton 13. The desired moisture control means 61 preferably consist of a Clarostat 53C3-10K potentiometer marketed by Clarostat Sensors and Controls, Inc., 12055 Rojas Drive, Suite K, El Paso, Tex. 79936, to allow the gin management, etc., to merely "dial in" the desired final moisture of the lint cotton 13 or cotton bale B.

In the fully automatic model or mode, the incoming moisture content measuring means 25 outs a 4–20 milliamp or 1–10 volt signal 28 to an analog input of the PLC 27, as it continuously scans the discharge from the battery condenser 15. This signal 28 to the PLC 27 is scaled by the PLC 27 to determine the presence of lint cotton 13 (used by the system to allow the water to spray) and the moisture content of the lint cotton 13 just prior to adding moisture to the lint cotton 13. The potentiometer of the desired moisture control means 61, in conjunction with a 10 volt DC power supply, is used to send an analog signal 63 to an analog input of the PLC 27. This signal 63 is scaled by the PLC 27 to determine the final bale percent moisture desired in the automatic mode.

The apparatus 11 may include a manual added moisture control means 65 for being set by gin management, etc., to send a signal 67 to the PLC 27, when the apparatus 11 is running in the manual mode or model, to identify the desired percent of moisture to add to the lint cotton 13. The manual desired moisture control means 65 preferably consist of a Clarostat 53C3-10K potentiometer marketed by Clarostat Sensors and Controls, Inc., 12055 Rojas Drive, Suite K, El Paso, Tex. 79936, to allow the gin management, etc., to merely "dial in" the percent of moisture to add to the cotton lint 13, regardless of the incoming or final moisture content of the cotton lint 13.

In the manual model or mode, the potentiometer of the manual desired moisture control means 65, in conjunction with a 10 volt power supply, is used to send an analog signal 67 to an analog input of the PLC 27. This signal 67 is scaled by the PLC 27 to determine the percent of moisture to be added to the lint cotton 13 based on the ginning rate, regardless of the incoming or final moisture content of the cotton lint 13.

The apparatus 11 may include a final moisture content measuring means 69 for measuring the moisture content of the cotton bale B after it leaves the bale press 17. The final moisture content measuring means 69 may include a radio frequency (RF) sensor 70. The RF sensor 70 can be mounted on the bale scales, or between the rollers 71' on a roller conveyor 71, etc. The radio frequency (RF) sensor 70 may be part of a Moisture Register Products BSP-901 RF Capacitance System marketed by Moisture Register Products, a division of Aqua Measure Instrument Co., 1712 Earhart Court, La Verne, Calif. 91750-0369.

The apparatus 11 preferably includes a control cabinet 72 for housing the PLC 27, booster pump 31, ball valve 35, filter 37, pressure regulator 39, pressure gauge 41, flow meter 43, flow control valve 47, automatic desired moisture control means 61, and manual desired moisture control means 65. The control cabinet 72 is preferably located as near as possible to the battery condenser 15.

The spray nozzle assembly 53, with the solenoid valves 55 and spray nozzles 59, is preferably mounted over the lint slide 19 as near the battery condenser 15 as practical.

Once the control cabinet 72 and spray nozzle assembly 53 are in place, the solenoid valves 55 are connected to the PLC 27, preferably via terminal strips. The external water supply or source 33 is connected to a water inlet port on the control cabinet . A water outlet port on the control cabinet 72 is connected to a water inlet port on the spray nozzle assembly 53. An external air supply 73 with a pressure between 60 and 100 pounds per square inch is connected to an air inlet port on the control cabinet 72 and, indirectly through the control cabinet 72, to the flow control valve 47. The ginning rate signal 30 is carried to the control cabinet 72 by wire or transmitted over radio frequency to a receiver at the control cabinet 72. The IR sensor 29 of the moisture content measuring means 25 should be mounted so it will be scanning the output of lint cotton 13 from the battery condenser 15 prior to the moisture being added to the lint cotton 13 via the spray nozzle assembly 53. The incoming moisture content signal 28 is carried to the control cabinet 72 preferably by cables provided with the moisture content measuring means 25. After this is completed, 110 volt AC power can be connected to a terminal strip of the control cabinet 72 at the PLC 27. The apparatus 11 is then ready for operation.

The PLC 27 is preferably controlled by the program disclosed in FIGS. 3A–3S, taken together and arranged as shown in FIG. 3, using a signal 30 from the rate measuring means 21 (e.g., analog outputs from potentiometers, transducers or sensors as hereinabove disclosed relative to the several possible embodiments of the rate measuring means 21) as inputs to V2000, V2001, V2002 in the program to calculate the rate of lint cotton 13 exiting the battery condenser 15 (i.e., the ginning rate of the gin stands). The analog output or signal 63 from the automatic desired moisture control means 61 is used in the program as V2003. The analog output or signal 28 from the moisture content measuring means 25 as determined from the lint cotton 13 preferably at the discharge of the battery condenser 15 is used in the program as V2004. The program calculates the set point and stores it in V1402. The process variable is the pulses, or signals, 45 from the flow meter 43 and is stored in V1403. The PLC 27 uses the V1402 and V1403 in the internal PID loop and controls the analog 4 to 20 milliamp output (signal 49) which controls the flow control valve 47. The PLC program then determines which and how many of the spray nozzles 59 should be applying moisture to the lint cotton 13, and sends the appropriate signals 57 to the appropriate solenoid valves 55.

The preferred method of the present invention includes the steps of measuring the incoming moisture content of the lint cotton 13 (in the automatic mode) between the battery condenser 15 and bale press 17 using, for example, the moisture content measuring means 25; measuring the rate of lint cotton 13 passing between the battery condenser 15 and the bale press 17 using, for example, the rate measuring means 21; and then adding a precise amount of moisture to the lint cotton between the battery condenser 15 and bale press 17 (i.e., on the lint slide 19) based on the desired moisture content of the cotton bale B, the moisture content of the lint cotton 13 between the battery condenser 15 and the bale press 17, and the rate of lint cotton 13 passing between the battery condenser 13 and the bale press 17 using, for example, the moisture adding means 23 and PLC 27.

As an example, assume the present invention is used with a gin having three gin stands, with one of the gin stands ginning at 10 bales of cotton per hour, another of the gin stands ginning at 12 bales of cotton per hour, and the last gin stand ginning at 8 bales of cotton per hour, resulting in a volume of 30 bales of cotton per hour (i.e., the rate measured by the rate measuring means 21); the moisture of the lint cotton 13 as measured by the moisture content measuring means 25, before adding any moisture thereto, is 4%; and the desired final moisture of the finished bale is 8%. The apparatus 11 will read the rate of ginning of each gin stand every half second, add them together and divide by 3600 to obtain the ginning rate in "bales per second." The PLC 27 will also subtract the moisture present (4% in this example) from the desired final bale moisture (8% in this example), resulting in the percent moisture to be added to the bale (4% in this example). Four percent moisture is equivalent to 20 pounds of water per bale. Therefore, in this example, the apparatus 11 will be spraying 0.1666 pounds of moisture per second (0.00833×20). The rate of ginning and amount of water needed per second is preferably recalculated every half second. The flow of water is controlled by the PLC 27. In this example, the PLC 27 will multiply the 0.1666 pounds of water per second needed by a factor of 182 pulses per pound (the number of pulses transmitted by the flow meter 43 for each pound of water that passes through it). This results in 30.332 pulses per second needed in order to deliver the 4% moisture to the lint cotton 13. That becomes the setpoint for the process. If the actual pulses being transmitted is above or below the setpoint, then the PLC 27 will open or close the flow control valve 47, regulating the flow of water, until the setpoint is obtained. Note that the setpoint is recalculated each half second and has the variables (1) ginning rate, (2) moisture prior to adding moisture, and (3) final bale desired moisture.

When used in the automatic mode or model (using the automatic desired moisture control means 61), the present invention will add a controlled and variable amount of moisture to the lint cotton 13 as it moves from the battery condenser 15 down the lint slide 19 on the way to the bale press 17, resulting in a finished bale moisture equal to the final bale percent moisture dial setting (set by gin management, etc.).

When used in the manual mode or model (using the manual desired moisture control means 65), a present amount of moisture will be added to the lint cotton, regardless of the incoming moisture, as the lint cotton 13 moves from the battery condenser 15 down the lint slide 19 on the way to the bale press 17, resulting in a finished bale B that has had the percent of moisture set by gin management (via a moisture to add dial of the manual desired moisture control means 61) added to the bale B.

The difference in the manual and automatic modes or models is that the manual model puts in a preset fixed amount of moisture that takes into consideration the ginning rate and moisture to add dial setting, but not the moisture content before adding moisture to the lint cotton. The automatic model makes it calculations based on the ginning rate, the lint cotton moisture content prior to adding moisture, and the final percent moisture dial setting in determining how much moisture to add, and the moisture that is being added is recalculated every half second.

As thus constructed and used, the present invention can automatically restore moisture to the cotton lint 13 during the ginning process, using both near infrared and radio frequency sensors to deliver a very accurate moisture regardless of the incoming moisture or the rate of ginning. Advantages of the present invention include, the provision and use of incoming lint or prior bale moisture readout, final bale moisture readout to verify that the final bale moisture is correct, user defined final bale moisture, and ginning rate to determine how much moisture to add to the lint cotton 13. Use of the present invention reduces compaction pressure required at the bale press 17 on both the tramper and the ram, increase the gin turnout (the ratio of weight of ginned lint to the weight of seed cotton), relaxes the cotton fiber, increasing the measured staple length, increases fiber strength and uniformity ratio, reduces lint fly at the bale press 17, and results in a more uniform baled weight due to the consistent moisture.

Although the present invention has been described and illustrated with respect to a preferred embodiment and a preferred use therefor, it is not to be so limited since modifications and changes can be made therein which are within the full intended scope of the invention.

Claims:

1. An apparatus for restoring moisture to lint cotton in a cotton gin including a battery condenser for forming lint cotton into a lint cotton batt, a bale press for pressing the lint cotton batt into a cotton bale having a desired moisture content, and a lint side between the battery condenser and the bale press, said apparatus comprising:

(a) rate measuring means for measuring the rate of lint cotton exiting the battery condenser; and (b) moisture adding means for adding a precise amount of moisture to the lint cotton between the battery condenser and the bale press based on the desired moisture content of the cotton bale, and the rate of lint cotton exiting the battery condenser.

2. The apparatus of claim 1 in which is included moisture content measuring means for measuring the moisture content of the lint cotton as it leaves the battery condenser.

3. The apparatus of claim 2 in which said moisture content measuring means includes an infrared sensor.

4. The apparatus of claim 3 in which said infrared sensor is a near infrared sensor.

5. A method for restoring moisture to lint cotton in a cotton gin including a gin stand and a bale press for pressing lint cotton into a cotton bale having a desired moisture content, said method comprising:

(a) measuring the rate of lint cotton passing between the gin stand and the bale press; and (b) adding a precise amount of moisture to the lint cotton between the gin stand and the bale press based on the desired moisture content of the cotton bale, and the rate of lint cotton passing between the gin stand and the bale press.

6. The method of claim 5 in which is included the step of measuring the moisture content of the lint cotton between the gin stand and the bale press.

7. A method for restoring moisture to lint cotton in a cotton gin including a battery condenser for forming lint cotton into a lint cotton batt, a bale press for pressing the lint cotton batt into a cotton bale having a desired moisture content, and a lint side between the battery condenser and the bale press, said method comprising:

(a) measuring the moisture content of the lint cotton as it leaves the battery condenser;

(b) measuring the rate of lint cotton exiting the battery condenser; and (c) adding a precise amount of moisture to the lint cotton between the battery condenser and the bale press based on the desired moisture content of the cotton bale, the moisture content of the lint cotton as it leaves the battery condenser, and the rate of lint cotton exiting the battery condenser.

* * * * *